US006537135B1

(12) United States Patent
Easter et al.

(10) Patent No.: US 6,537,135 B1
(45) Date of Patent: Mar. 25, 2003

(54) CURVILINEAR CHEMICAL MECHANICAL PLANARIZATION DEVICE AND METHOD

(75) Inventors: William G. Easter, Orlando, FL (US); John A. Maze, III, Orlando, FL (US); Sailesh M. Merchant, Orlando, FL (US); Frank Miceli, Orlando, FL (US); Charles W. Pearce, Emmaus, PA (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/459,708

(22) Filed: Dec. 13, 1999

(51) Int. Cl.[7] ..... B24B 1/00

(52) U.S. Cl. ..... 451/36; 451/41; 451/283; 451/287

(58) Field of Search ..... 451/36, 41, 283, 451/285, 287, 59, 63, 288, 289, 290, 398

(56) References Cited

U.S. PATENT DOCUMENTS 5,184,433 A * 2/1993 Maack
5,549,511 A 8/1996 Cronin et al.
5,938,884 A * 8/1999 Hoshizaki et al.
5,980,363 A * 11/1999 Meikle et al.
6,007,408 A * 12/1999 Sandhu
6,007,411 A * 12/1999 Feeney
6,015,337 A * 1/2000 Hiyama et al.
6,290,578 B1 * 9/2001 Bowman et al.

* cited by examiner

*Primary Examiner*—Joseph J. Hail, III
*Assistant Examiner*—Willie Berry, Jr.

(57) ABSTRACT

The present invention relates to an apparatus and method for polishing substrate surfaces. The method can include the steps of holding a substrate against a polishing surface and depositing slurry on the polishing surface. The method can further include the step of moving the holding device in a substantially curvilinear path relative to the polishing surface, or the step of moving the polishing surface in a substantially curvilinear path relative to the holding device. The apparatus comprises a polishing surface, a holding device for holding a substrate against the polishing surface, and a slurry supply system for depositing slurry on the polishing surface. The apparatus further includes a moving structure for moving the holding device in a substantially curvilinear path along the polishing surface, or a moving structure for moving the polishing surface in a substantially curvilinear path relative to the holding device. The substantially curvilinear path is preferably substantially a figure eight path.

2 Claims, 4 Drawing Sheets

CURVILINEAR CHEMICAL MECHANICAL PLANARIZATION DEVICE AND METHOD

CROSS-REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Field of the Invention

This invention relates generally to the field of semiconductor wafer fabrication, and more particularly to the field of chemical mechanical planarization (CMP) of thin films used in semiconductor wafer fabrication.

2. Description of the Related Art

The production of integrated circuits begins with the creation of high quality semiconductor wafers. A semiconductor wafer typically includes a substrate, such as a silicon or gallium arsenide wafer, on which a plurality of transistors have been formed. Transistors are chemically and physically formed in and on a substrate by patterning regions in the substrate and patterning layers on the substrate. The transistors are interconnected through the use of well known multilevel interconnects to form functional circuits. Typical multilevel interconnects are comprised of stacked thin films, commonly comprised of one or more of the following: titanium (Ti), titanium nitrite (TiN), tantalum (Ta), aluminum-copper (Al—Cu), aluminum-silicon (Al—Si), copper (Cu), and tungsten (W).

During the wafer fabrication process, the wafers may undergo multiple masking, etching, dielectric deposition, and conductor deposition processes. An extremely flat, or planarized, surface is generally needed on at least one side of the semiconductor wafer to ensure proper accuracy and performance of the microelectronic structures being created on the wafer surface. In general, a wafer can be polished to remove high topography, surface defects such as crystal lattice damage, scratches, roughness or embedded particles. As the size of integrated circuits continues to decrease and the density of microstructures on an integrated circuit continues to increase, the need for precise wafer surfaces becomes more important. Therefore, between each processing step, it is usually necessary to polish the surface of a wafer in order to obtain the most planarized surface possible.

CMP is routinely used to planarize the surface of the layers, or thin films, of the wafer during the various stages of device fabrication. CMP has emerged as the planarization method of choice because of its ability to planarize better than traditional planarization methods. During a CMP process, polishing planarizes surfaces to very precise tolerances, which is essential for maintaining the precise photolithographic depth of focus required for integrated circuit chip fabrication. In a typical CMP process, the wafer is held by a rotating carrier with the active wafer surface facing a rotating polishing table, called a platen. On top of the platen is a porous polyurethane polishing surface on which is poured a slurry. The slurry can be colloidal silica suspended in an aqueous solution. Slurries with different chemical compositions are used to polish metals and other films. During metal polishing, the slurry chemically reacts with the wafer's surface, forming a passive layer on a portion of the wafer's surface, while the mechanical force exerted by the pad and the colloidal silica particles abrades the wafer's surface, removing the passive layer.

A CMP slurry serves several functions. Most notably, it is the medium in which abrasive particles are dispersed. Additionally, it furnishes the chemical agents which promote the chemical process. To obtain optimum results from CMP processing, there must be a synergistic relationship between the chemical and mechanical processes.

For example, CMP slurries for polishing a metal layer commonly comprise a metal oxidizer and an abrasive agent. The oxidizer reacts with the metal to form a passive metal oxide layer. During the polishing process, the abrasive agent removes the passive oxide layer from elevated portions of the metal layer. Depressed portions of the metal layer surface are not subjected to mechanical abrasion and, therefore, the protected material underlying depressed portions of the passive oxide layer is not polished. This process continues until the elevated portions of the metal layer have been polished away, resulting in planarization.

The ideal polishing process can be described by Preston's equation: $R=K_p*P*V$, where R is the removal rate, P is the applied pressure between the wafer and the polishing surface, V is the relative velocity between the wafer and the polishing surface, and $K_p$ is a function of consumables such as polishing surface roughness, elasticity, and chemistry. The ideal CMP process has constant pressure between the polishing surface and the wafer, constant polishing surface roughness, elasticity, area, and abrasion effects, and constant velocity over the entire wafer surface. Having constant velocities at points which are distant from the center of the wafer is generally preferable to having fluctuating velocities because the removal rate is much easier to control when constant velocity conditions exist. For example, when points at a distance from the center of the wafer are exposed to alternating high and low velocities, the abrasive material may scratch the surface of the wafer and result in a non-planarized surface. Non-uniform removal of films from the surface of a wafer is a common problem encountered during CMP processing because there are numerous variables which can affect planarization.

In a typical CMP process, the wafer carrier and the platen rotate in the same direction, but with the two rotating axes offset by some distance. This arrangement results in relative linear motion between any position on the wafer and the polishing surface. Thus, removal caused by the polishing surface is related to the radial position of the wafer relative to the platen. The removal rate increases as the wafer moves radially, or linearly, outward relative to the platen. Removal rates tend to be higher at the edges of the wafer than at the center of the wafer. As a result, wafer surfaces tend to become higher at the center of the wafer as compared to the edges of the wafer. Reducing this center-to-edge variation results in a more planarized wafer surface.

Attempts have been made to reduce this center-to-edge variation by polishing in non-linear polishing patterns. One approach includes affixing a mechanical template having a non-linear opening to a polishing surface. A rotating motor moves a wafer carrier along the edges of the non-linear template, allowing the wafer carrier to traverse the surface of the polishing surface in a non-linear manner. This approach is significantly limited, however, because it requires attaching a device to the polishing surface. Such a configuration can significantly reduce the polishing surface lifespan by causing uneven wear of the polishing surface. The direct contact between the template and the polishing surface also reduces the lifespan of the polishing surface because the template can introduce particles and other defects into the polishing surface. Another approach involves the use of a non-linear carrier displacement mechanism for moving a wafer carrier across a polishing surface. A drawback to this configuration is that it does not provide a means for moving a wafer across a polishing surface along a substantially figure eight path.

SUMMARY OF THE INVENTION

The present invention relates to an improved apparatus and method for planarizing the surface of a substrate, such as a semiconductor wafer. In one embodiment of the invention, the apparatus for polishing substrate surfaces includes a polishing surface, a holding device for holding a substrate against the polishing surface, a slurry supply system for depositing slurry on the polishing surface, and structure for moving the holding device in a substantially figure eight path relative to the polishing surface. The moving structure can comprise a motor and an actuating arm connecting the motor to the holding device.

In another embodiment, the apparatus for polishing substrate surfaces includes a polishing surface, a holding device for holding a substrate against the polishing surface, a slurry supply system for depositing slurry on the polishing surface, and a structure for moving the holding device in a substantially curvilinear path relative to the polishing surface. In this embodiment, the moving structure can include a drive which is attached to the holding device, structure for rotating the drive, and at least one steering device for steering the drive in a substantially curvilinear path relative to the polishing surface. The substantially curvilinear path can be a substantially figure eight path. The steering device can be one or more cams.

Yet another embodiment of the invention comprises a polishing surface, a holding device for holding at least one substrate against the polishing surface, a slurry supply system for depositing slurry on the polishing surface, and a moving structure. The moving structure can include a drive which is attached to the holding device and rotates the holding device, and counter-rotating devices having structure for engaging the holding device. The counter-rotating devices alternately engage the holding device, thereby moving the holding device in a substantially curvilinear path relative to the polishing surface. The substantially curvilinear path can be a substantially figure eight path.

A method for polishing substrate surfaces according to the invention includes the steps of holding a substrate against a polishing surface with a holding device, depositing slurry on the polishing surface, and moving the holding device in a substantially figure eight path relative to the polishing surface with moving structure. The step of moving the holding device in a substantially figure eight path relative to the polishing surface can be performed with a motor and an actuating arm connecting the motor to the holding device.

Another method according to the invention includes the steps of holding a substrate against a polishing surface with a holding device, depositing slurry on the polishing surface, rotating the holding device with a drive attached to the holding device, and steering the drive in a substantially curvilinear path relative to the polishing surface with at least one steering device. The substantially curvilinear path can be a substantially figure eight path, and the steering device can be one or more cams.

Still another method according to the invention includes the steps of holding a substrate against a polishing surface with a holding device, depositing slurry on the polishing surface, rotating the holding device with a drive attached to the holding device, providing a plurality of counter-rotating devices having structure for engaging the holding device, and rotating the counter-rotating devices. The counter-rotating devices alternately engage the holding device, whereby the holding device moves in a substantially curvilinear path relative to the polishing surface.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
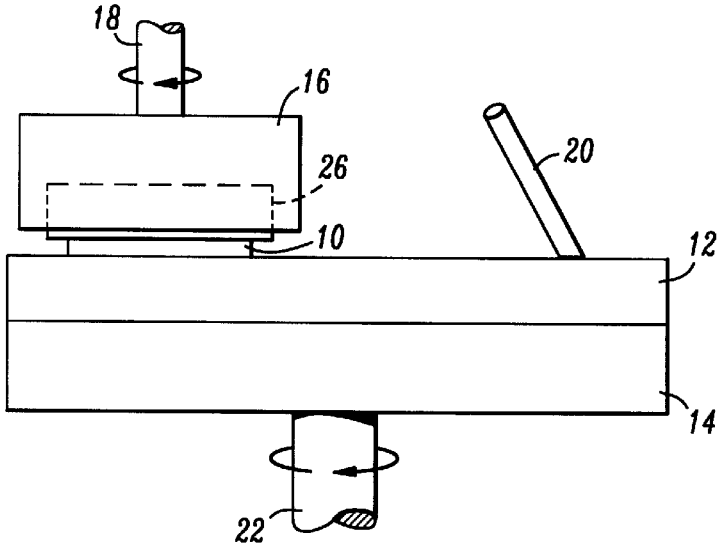
FIG. 1 (PRIOR ART)
FIG. 1 is a side schematic view of a conventional CMP apparatus.
Figure 2:
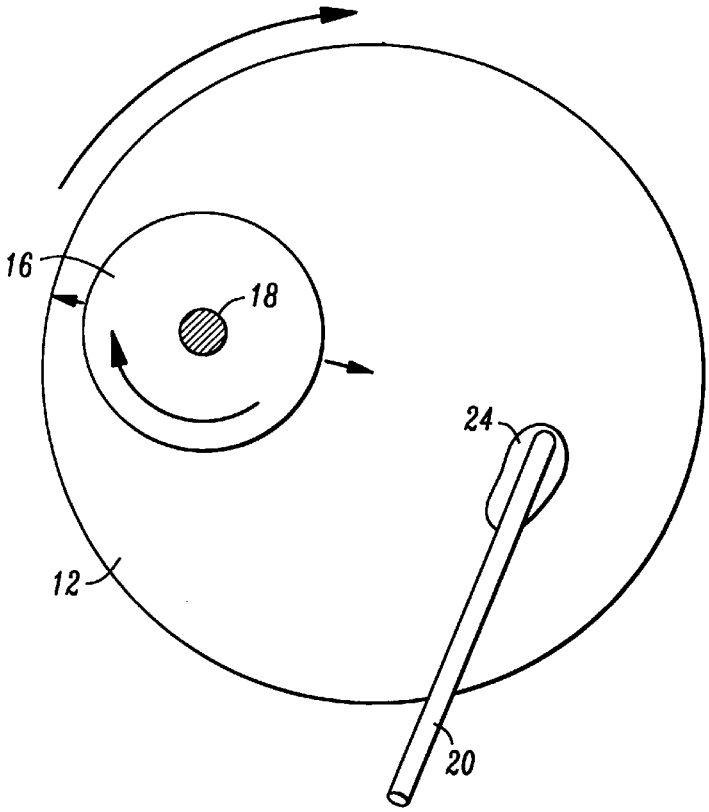
FIG. 2 (PRIOR ART)
FIG. 2 is a top schematic view of the conventional apparatus of FIG. 1.

In FIGS. 1 and 2, a semiconductor wafer 10 is shown pressed against a polishing surface 12, which is preferably a polishing pad. The wafer 10 is pressed against the polishing surface 12 by a wafer carrier 16. In a conventional CMP device, the wafer 10 is held face-down by the wafer carrier 16. A thin synthetic film (not shown) can rest on the back side of the wafer 10. The synthetic film can have small holes through which back pressure may be applied during polishing. The back pressure can be used to prevent wafer bowing during polishing and to improve polishing uniformity.

The wafer carrier 16 is often composed of a material which can damage the wafer 10 if it directly contacts the wafer 10. Therefore, the wafer carrier 16 can be pressed against a wafer holder 26 which helps protect the wafer 10 by separating the wafer carrier 16 from the wafer 10. The wafer carrier 16 can also be rotated by a wafer carrier spindle 18, causing the wafer 10 to rotate as it contacts the polishing surface 12.

According to conventional CMP processes, the wafer 10 is pressed against the polishing surface 12, and a slurry supply system 20 applies slurry 24 to the polishing surface 12. During the CMP process, a platen spindle 22 rotates the platen 14, independent of the rotation of the wafer 10 and the wafer carrier 16. The rotation of the platen 14 and the wafer carrier 16 causes the wafer 10 to move through the slurry 24 in a rotary fashion. As slurry 24 flows over the surface of the wafer 10, the suspended particles in the slurry 24 and the polishing surface 12 mechanically abrade the surface and the liquid in the slurry 24 chemically etches the abraded area. In this manner, a substantial amount of material from the high spots on the wafer 10 is removed, while a negligible amount of material from the low spots on the wafer 10 is removed, resulting in a flattened, or planarized, wafer 10.

Figure 3A:
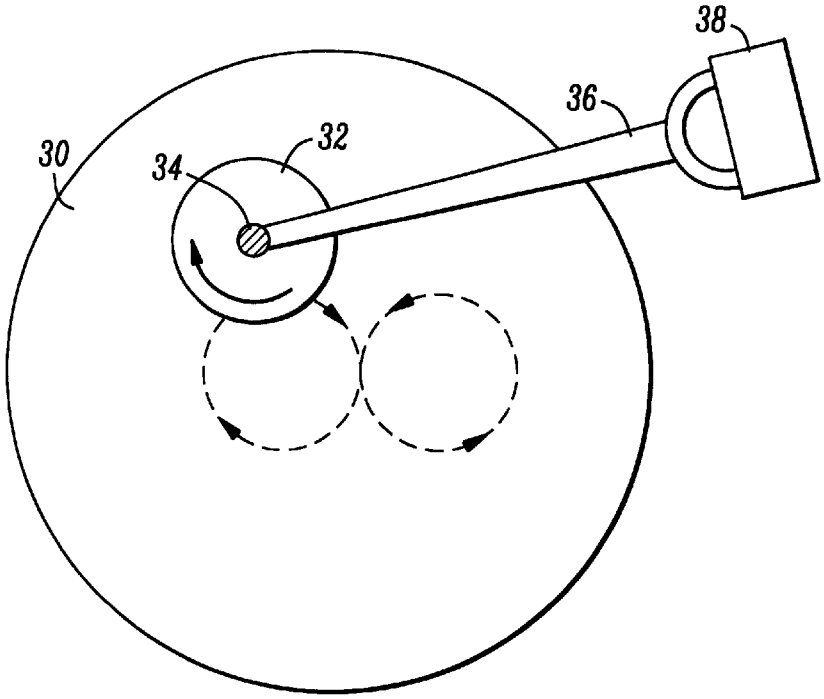
FIG. 3*a* is a top schematic view of a curvilinear polishing system showing curvilinear polishing according to the invention.

FIG. 3*a* shows curvilinear polishing according to the present invention. A wafer carrier 32 presses the surface of a wafer (not shown) against a polishing surface 30. Preferably, the wafer carrier 32 can move axially and laterally relative to the polishing surface 30. As the wafer carrier 32 moves the wafer across the polishing surface 30, the wafer carrier 32 can be rotated by a drive 34. The drive 34 is preferably a flexible rod or a connector that is rotated by a motor (not shown). The drive 34 can rotate the wafer carrier 32 in any suitable manner.

The wafer carrier 32 can be rotated by the drive 34 while the wafer carrier 32 moves curvilinearly across the polishing surface 30. Curvilinear paths followed by the wafer carrier 32 preferably extend across the diameter of the polishing surface 30. In a particularly preferred arrangement, the curvilinear path traveled by the wafer carrier 32 as it moves relative to the polishing surface 30 substantially takes the shape of one or more figure eight paths. An advantage of figure eight paths is that such paths expose the wafer to multiple directions of polishing. Accordingly, although a wafer traversing a figure eight path across the polishing surface 30 may be scratched by the polishing surface 30 as it moves along a first portion of the figure eight path, such abrasions can be removed as the wafer traverses a second portion of the figure eight path. Similarly, wafer surface imperfections not removed as the wafer moves through the first portion of the figure eight path can be removed as the wafer traverses the second portion of the figure eight path.

The substantially figure eight paths may be of any suitable size. For example, the substantially figure eight paths can be large enough to extend across the diameter of the polishing surface 30. Substantially figure eight paths large enough to extend across the diameter of the polishing surface 30 can allow even wear of the polishing surface.

An actuating arm 36 can connect a motor 38 to the drive 34. The motor 38 can move the arm 36, and thus the attached wafer carrier 32, curvilinearly across the polishing surface 30. The motor 38 can be programmed to move the arm 36 in any desirable curvilinear direction, including a substantially figure eight path.

Figure 3B:
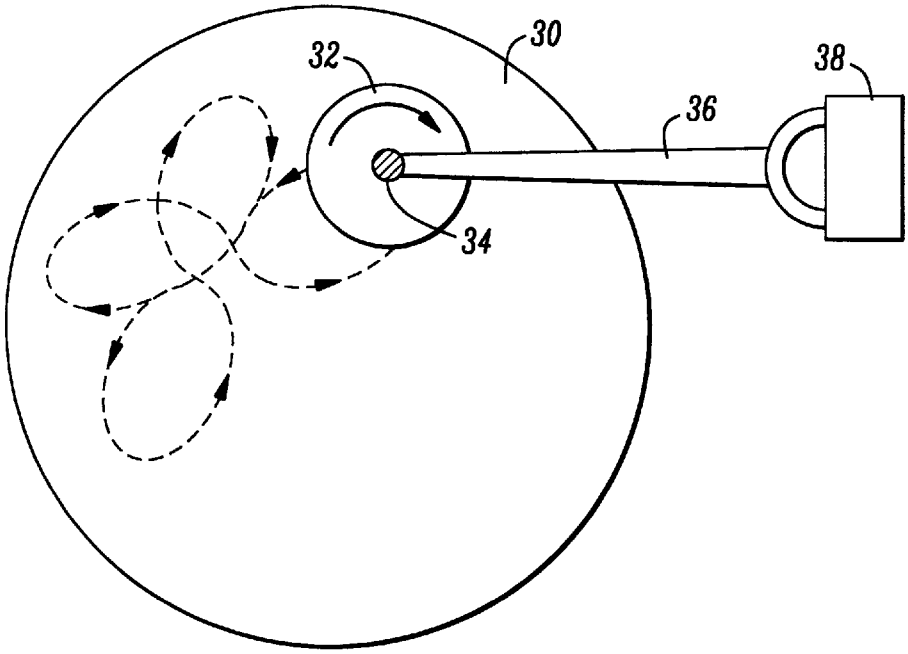
FIG. 3*b* is a top schematic view of an alternative curvilinear polishing system showing curvilinear polishing according to the invention.
Figure 3C:
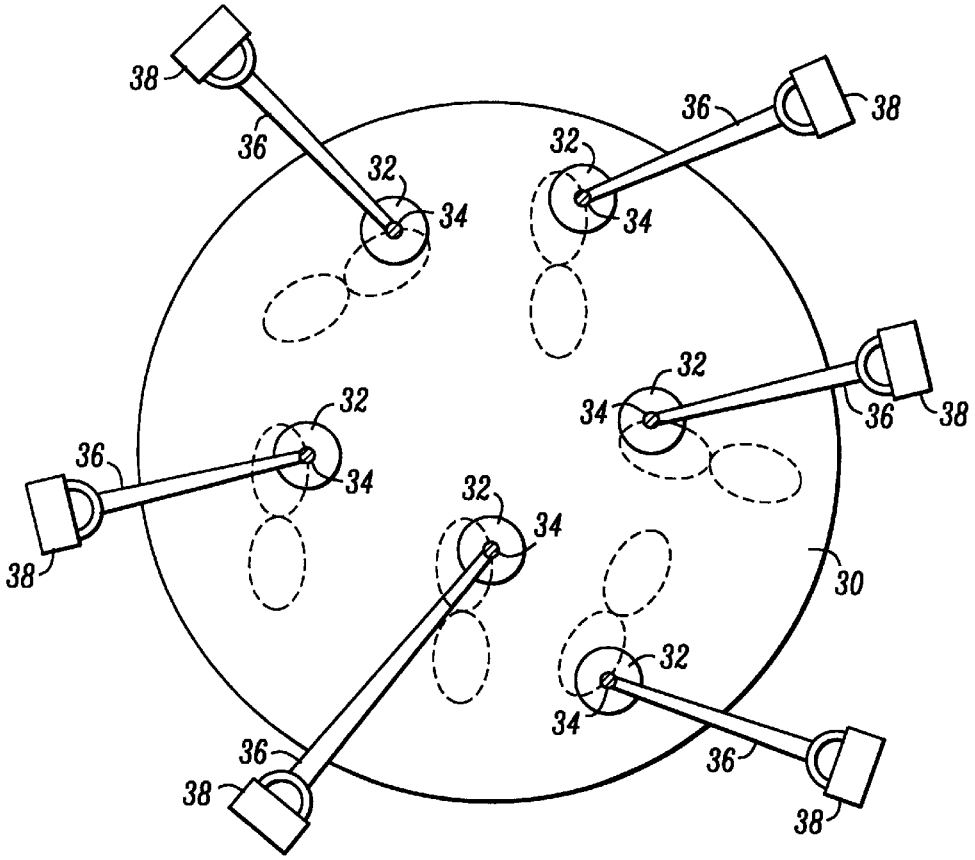
FIG. 3*c* is a top schematic view of a curvilinear polishing system showing curvilinear polishing of a plurality of wafers with a plurality of wafer carriers according to the invention.

In FIG. 3*a,* the wafer carrier 32 is shown traversing a substantially figure eight path near the center of rotation of the polishing surface 30. As shown in FIG. 3*b,* however, each substantially figure eight path can begin and end at any point along the polishing surface 30. Additionally, as shown in FIG. 3*c,* the apparatus according to the invention may utilize multiple wafer carriers 32. Each wafer carrier 32 can independently traverse the polishing surface 30 by following one or more substantially figure eight paths. Each wafer carrier 32 can be moved along the substantially figure eight paths by an arm 36 which is connected to a motor 38.

In another embodiment of the invention, the wafer can be held substantially stationary against the polishing surface 30, while the polishing surface 30 moves in a substantially curvilinear manner. In this embodiment, any suitable motor (not shown) can be used to move the polishing surface 30 in a substantially curvilinear manner. The substantially curvilinear motion is preferably a substantially figure eight motion.

Figure 4:
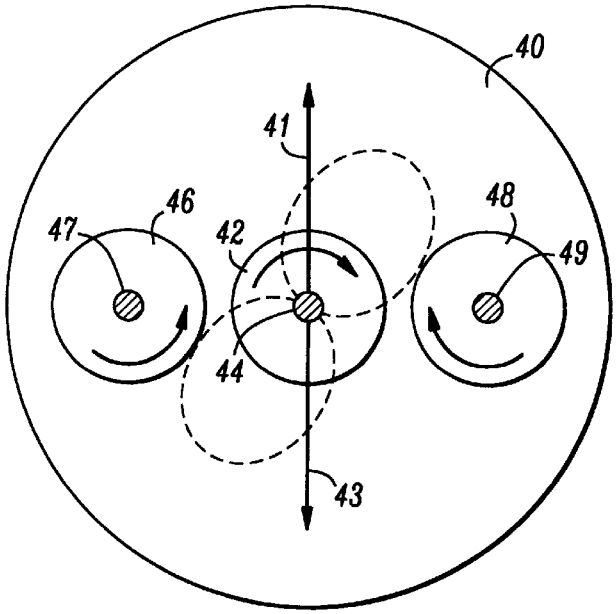
FIG. 4 is a top schematic view of a curvilinear polishing system with steering devices according to the invention.
Figure 5:
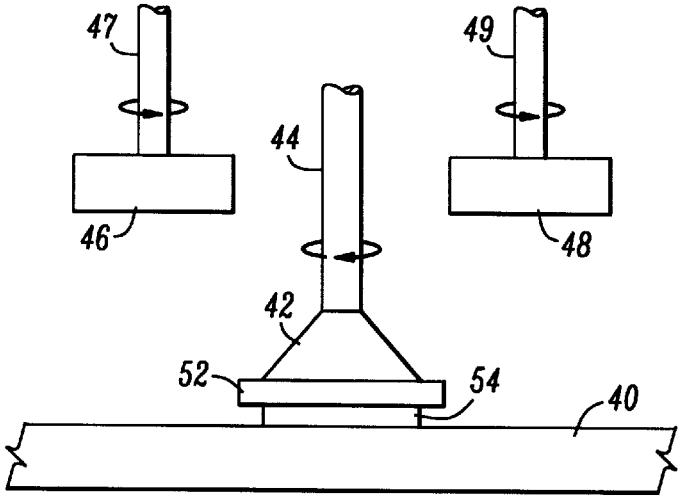
FIG. 5 is a side schematic view of the rotating devices of FIG. 4.

There are many other ways to impart curvilinear motion according to the invention. FIGS. 4 and 5 show an embodiment in which one or more steering devices 46, 48 steer a wafer carrier 42 across a polishing surface 40 in a curvilinear manner. The steering devices 46, 48 may be any mechanism suitable for steering the wafer carrier 42, but preferably are cams. Each steering device 46, 48 can be attached to a motor (not shown) by an actuating arm 47, 49. The motors and actuating arms 47, 49 rotate each steering device 46, 48 about its respective axis. The wafer carrier 42 has a drive 44 which rotates the wafer carrier 42 about its axis as it traverses the polishing surface 40. The drive 44 is preferably a flexible rod or a connector that is rotated by a motor (not shown). The wafer carrier 42 is shown pressing the wafer holder 52 against the back surface of the wafer 54, and the wafer holder 52 is shown pressing the surface of the wafer 54 being polished against the polishing surface 40.

For this embodiment, the movement of the wafer carrier 42 in a substantially curvilinear or a substantially figure eight motion can be caused by two independent motions. For example, this movement can be caused by the wafer carrier 42 moving linearly across the polishing surface 40 as indicated by arrows 41 and 43, while steering devices 46, 48 steer the drive 44 in a curvilinear manner by alternately pressing against the drive 44. Contact between a steering device 46, 48 and the drive 44 communicates motion to the drive 44, which permits the drive 44 to push the wafer carrier 42 relative to the polishing surface 40. The motion communicated to the drive 44 can be dictated by the geometry of the edges of the steering devices 46, 48 or the geometry of one or more grooves cut in the edges of the steering devices 46, 48. The steering devices 46, 48 can be configured to move the drive 44, and thus the attached wafer carrier 42, along any desirable curvilinear path along the polishing surface 40. As previously indicated, however, it is preferable for this curvilinear path to substantially take the shape of a figure eight.

Figure 6:
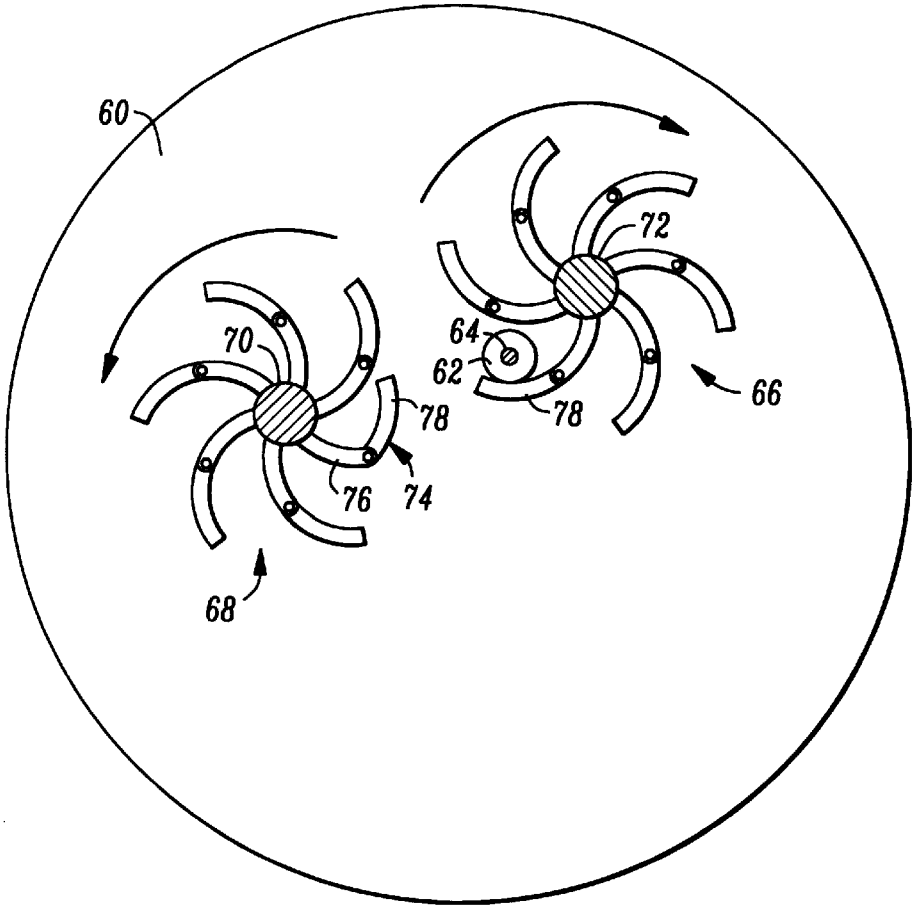
FIG. 6 is a top schematic view of a curvilinear polishing system with counter-rotating devices according to the invention.

Another embodiment of the invention is shown in FIG. 6. This embodiment includes a plurality of counter-rotating devices 66, 68 which move a wafer carrier 62 in a curvilinear path relative to a polishing surface 60. Preferably, the curvilinear path is one or more substantially figure eight paths. Each counter-rotating device 66, 68 can be rotated about its axis by a drive 70, 72. The wafer carrier 62 also has a drive 64 which rotates the wafer carrier 62 about its axis as it traverses the polishing surface 60. Any suitable motor can provide the rotation of the drives 64, 70, 72.

Each counter-rotating device 66, 68 has one or more extension arms 74 extending radially outward relative to its center. Preferably, the extension arms 74 have a main portion 76 and a contact portion 78. Each main portion 76 can be attached to a contact portion 78 in any suitable manner. Preferably, the main portion 76 is attached to the contact portion 78 by a pin, so that the contact portion 78 can pivot relative to the main portion 76. The contact portion 78 carries the wafer carrier 62 as the counter-rotating devices 66, 68 move the wafer carrier 62 relative to the polishing surface 60.

During operation, the counter-rotating devices 66, 68 alternate moving the wafer carrier 62 relative to the polishing surface 60. Accordingly, each counter-rotating device 66, 68 can receive the wafer carrier 62 in one of its extension arms 74, complete approximately one revolution, and then transfer the wafer carrier to the other of the counter-rotating devices 66, 68. The contact portion 78 of the extension arm 74 holding the wafer carrier 62 can pivot at least slightly towards or away from the main portion 76 of the extension arm 74 as the wafer carrier 62 is transferred from one counter-rotating device 66, 68 to another counter-rotating device 66, 68. The counter-rotating devices 66, 68 allow the wafer carrier 62 to traverse the polishing surface 60 along a curvilinear path. Preferably, the curvilinear path is a substantially figure eight path.

It is understood that the embodiments of the present invention are described in the context of devices and methods for polishing semiconductor wafers, although those skilled in the art will recognize that the disclosed devices and methods are readily adaptable for other applications, including polishing of substrates other than semiconductor wafers. It should also be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

What is claimed is:

1. A method for polishing substrate surfaces, said method comprising the steps of:

holding a substrate against a polishing surface with a holding device;

depositing slurry on the polishing surface;

rotating the holding device with a drive, wherein the drive is attached to the holding device;

providing a plurality of counter-rotating devices having structure for engaging the holding device; and rotating the counter-rotating devices, wherein the counter-rotating devices alternately engage the holding device, whereby the holding device moves in a substantially curvilinear path relative to the polishing surface.

2. The method according to claim 1, further comprising the step of rotating the counter-rotating devices, wherein the counter-rotating devices alternately engage the holding device, whereby the holding device moves in a substantially figure eight path relative to the polishing surface.

* * * * *